United States Patent [19]

Seldon

[11] Patent Number: 4,480,424

[45] Date of Patent: Nov. 6, 1984

[54] BOTTLE SEALING APPARATUS AND METHOD

[76] Inventor: Philip Seldon, 370 E. 76th St., New York, N.Y. 10021

[21] Appl. No.: 319,642

[22] Filed: Nov. 9, 1981

[51] Int. Cl.[3] ..... B67B 1/04; B67B 1/08; B65B 7/28

[52] U.S. Cl. ..... 53/489; 53/478; 215/269; 215/354; 220/232

[58] Field of Search ..... 53/478, 488, 489, 330, 53/348, 361, 477, 467, 403, 404; 215/269, 270, 354, 358, 327, 324; 220/239, 232, 256

[56] References Cited

U.S. PATENT DOCUMENTS

| | | | |
|---|---|---|---|
| 288,603 | 11/1883 | Schlieffen | 215/269 |
| 713,708 | 11/1902 | Spire | 215/269 |
| 794,987 | 7/1905 | Kneuper | 215/269 |
| 2,115,035 | 4/1938 | Morgan | 220/232 X |
| 2,494,915 | 1/1950 | Vander Poel | 53/403 |
| 2,715,087 | 8/1955 | Barradas | 53/477 X |
| 2,926,705 | 3/1960 | Dorn | 53/403 X |
| 3,051,343 | 8/1962 | Pappas | 215/269 |
| 3,979,004 | 9/1976 | Bertario | 215/354 X |
| 4,243,448 | 1/1981 | Fagniart et al. | 53/477 X |
| 4,251,073 | 2/1981 | Birdsong, Jr. | 53/403 X |

*Primary Examiner*—Horace M. Culver

[57] ABSTRACT

An inflatable member fabricated of an elastomeric expandable material is provided. The inflatable member has a sack-like configuration and is provided with a substantially centrally disposed nipple. A plastic disc is secured to the upper portion of the inflatable member or formed integrally therewith and the nipple extends upwardly through a central aperture in the disc. The inflatable member is positioned within the neck of a bottle, especially a wine bottle, with the disc positioned atop the lip of the bottle. The inflatable member is then filled with a pressurized inert gas through the nipple causing the elastomeric material to expand and be forced into contiguous and coextensive relationship with an interior portion of the bottle neck, thereby hermetically sealing the bottle. The nipple is then heat fused to maintain the hermetic seal.

22 Claims, 7 Drawing Figures

FIG. 1
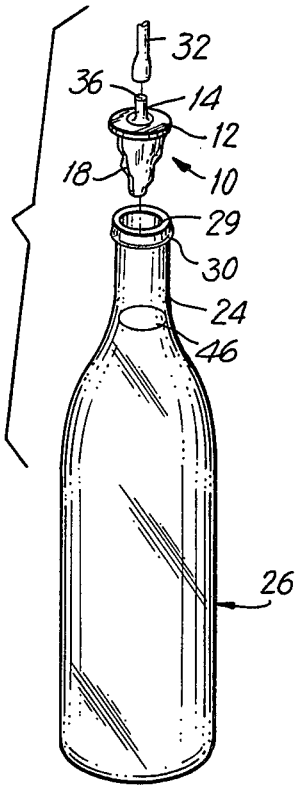
FIG. 2
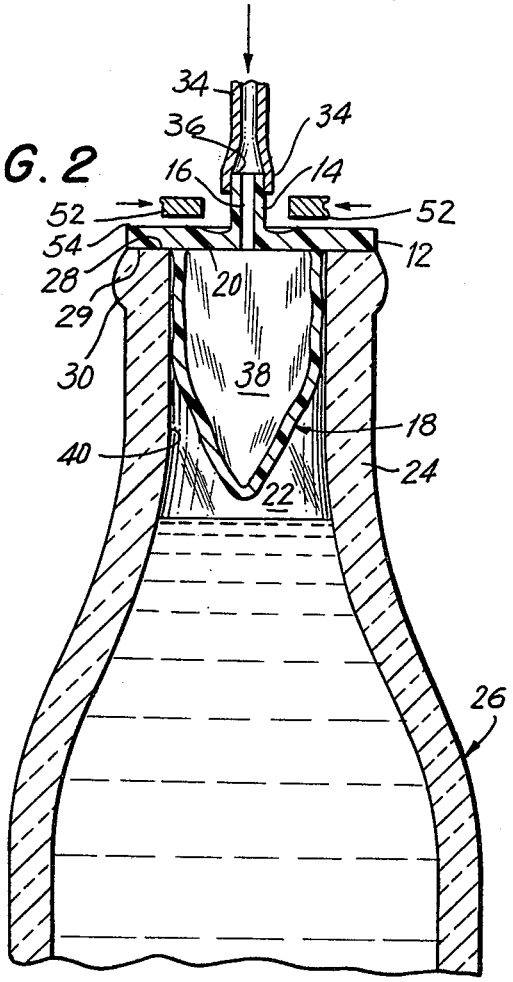
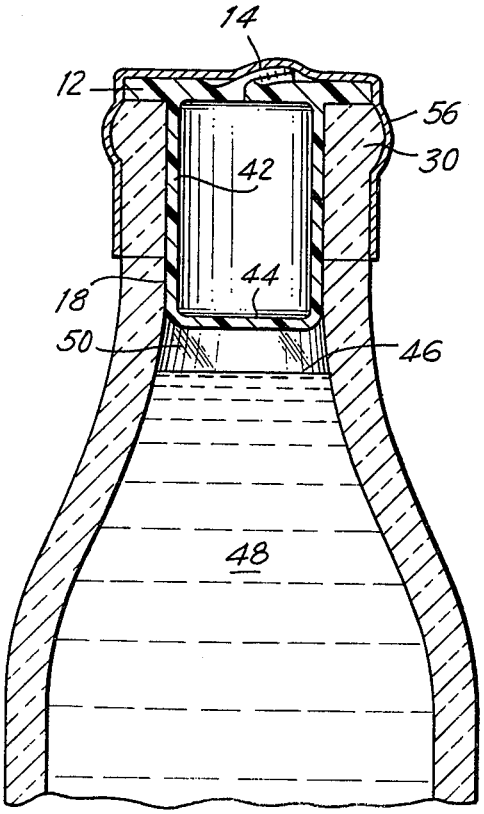
FIG. 3

FIG. 4
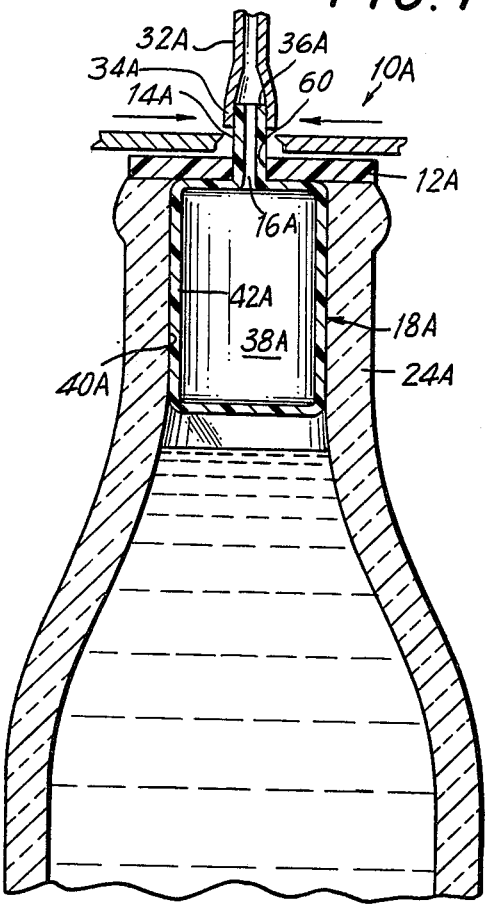
FIG. 5
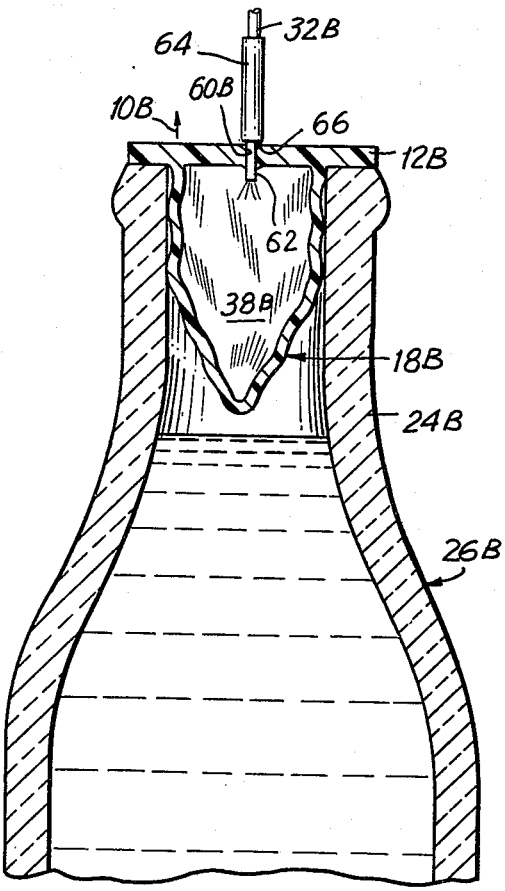
FIG. 6
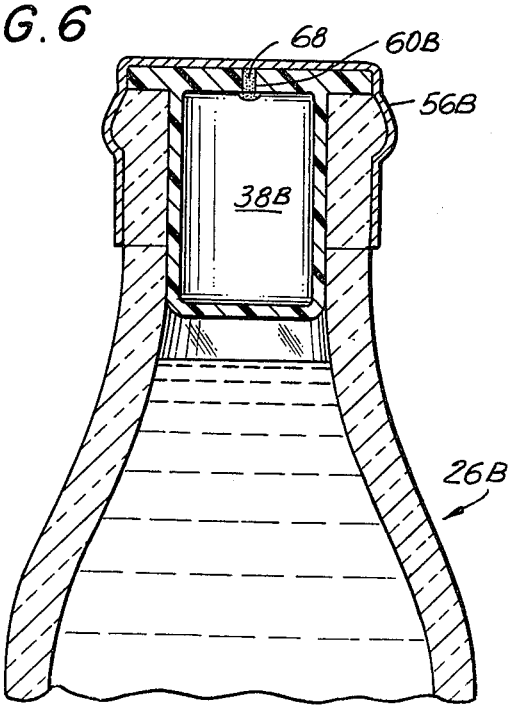
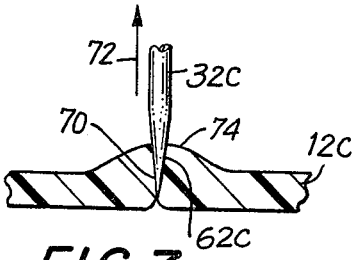
FIG. 7

BOTTLE SEALING APPARATUS AND METHOD

BACKGROUND OF THE INVENTION

With the ever increasing manufacture and consumption of wine and the concomitant decrease in the supply of cork, there has been created a need for a new type of wine bottle stopper which is reliable to prevent permeation of ambient air into the wine after filling of the wine bottles. The stopper must be reliable, relatively inexpensive, easy to employ and have longevity characteristics equal to or greater than that presently exhibited by cork, so as to permit the laying down of the filled bottles of wine for maturation and subsequent consumption without need for concern of premature oxidation and spoilage of the wine.

The universally accepted wine bottle stopper is cork but the supply thereof is dwindling accompanied by a deterioration of the quality thereof. Should a cork stopper become dry or brittle, it ceases to serve its required function and air will seep therethrough, thereby contaminating the wine by causing unknown and premature oxidation thereof which will ultimately cause the wine to turn vinegary and unfit for drinking.

Screw-on type bottle closures have been used in conjunction with long term wines but have generally been found to be unacceptable for closures of wine bottles. While prior art closures have promulgated inflatable members in necks of bottles, these closures have either been of the types which have provided temporary closures, use expensive and complex valve assemblies or which have evacuated the bottle itself to cause expansion of rubber bladders by ambient air pressure. These and similar type devices have been shown in the prior art by U.S. Pat. Nos. 54,201; 288,603; 337,974; 713,708; 2,425,841; 3,343,701 and 3,609,940.

OBJECTS OF THE INVENTION

It is the primary object of the present invention to provide a new and novel bottle sealing device, especially for use in conjunction with wine bottles.

It is another object of the present invention to provide a bottle sealing device of the foregoing type which will provide an hermetic seal.

It is yet a further object of the present invention to provide a bottle sealing device of the aforementioned type which will not decay with age, which is alcohol impervious and which is capable of rather inexpensive fabrication.

It is still a further object of the present invention to provide a bottle sealing device of the above-described type which is capable of easy access and removal when the wine bottle is to be opened.

It is yet another object of the present invention to provide a new and novel method of insertion and securement of the bottle sealing device of the present invention within the neck of a wine bottle.

SUMMARY OF THE INVENTION

In accordance with but one of the embodiments of the present invention, there is provided a bottle sealing apparatus comprising an upper plastic disc member provided with a centrally disposed hollow nib. The disc being fabricated of a substantially rigid but deformable plastic material. Secured to the underside central portion of the disc is an inflatable member fabricated of an elastomeric expandable material. The inflatable member is placed into the neck of the bottle after the same has been filled with wine. The peripheral portion of the underside of the disc rests on the lip of the bottle. Thereafter a tube is placed upon the upper portion of the nib in surrounding engagement therewith. A pressurized inert gas, such as nitrogen or carbon dioxide, is then supplied to the inflatable member. Initially, the pressurized gas causes the inflatable member to be forced downwardly, whereby the disc is forced against the lip of the bottle. The inflatable member then expands and is forced into coextensive conformity with the interior of the bottle neck. After the pressure within the inflatable member is substantially equal to that of the pressurized source, heat fusing elements are brought into contact with the nib to close and seal the same, thereby sealing the pressurized inflatable member and hermetically sealing the neck of the bottle. Thereafter, the tube is removed from the closed nib, the nib is bent downwardly upon the upper surface of the disc and a secondary closure member such as hard plastic, lead foil or other suitable material is placed upon the upper neck portion of the hermetically sealed bottle.

BRIEF DESCRIPTION OF THE DRAWINGS

The foregoing and other objects, features and advantages of the present invention will become readily apparent to those skilled in the art from the detailed description hereinafter, considered in conjunction with the accompanying drawings, wherein:

FIG. 1 is an exploded perspective view of a bottle sealing apparatus constructed in accordance with a first embodiment of the present invention;

FIG. 2 is a partial sectional view illustrating the initial placement of the bottle sealing apparatus depicted in FIG. 1;

FIG. 3 is a partial sectional view similar to FIG. 2, after securement of the bottle sealing apparatus has been effectuated and a hermetic seal has been formed;

FIG. 4 is a partial sectional view depicting a second embodiment of the bottle sealing apparatus of the present invention:

FIG. 5 is a partial sectional view depicting a third embodiment of the bottle sealing apparatus of the present invention, after initial placement thereof in the neck of a bottle;

FIG. 6 is a partial sectional view similar to FIG. 5 depicting the bottle sealing apparatus thereof after the formation of a hermetic seal: and FIG. 7 is a fragmentary sectional view depicting a fourth embodiment of the present invention.

DETAILED DESCRIPTION OF THE PREFERRED EMBODIMENTS

Referring now to the drawings, and more particularly to FIGS. 1 through 3 thereof, there is depicted a first embodiment of the bottle sealing apparatus of the present invention which apparatus is generally denoted by the reference numeral 10. The apparatus comprises a circular disc member 12 having a hollow nib 14 formed integrally therewith. A centrally disposed opening 16 extends through the nib 14 and disc 12. The disc 12 and nib portion 14 are formed of a substantially rigid but deformable plastic material. An inflatable member or sack 18 is secured to the underside central portion 20 of the disc 12. The member 18 may be fabricated from an expandable elastomeric material and has an initial substantially conical or deflated cylindrical configuration.

The apparatus 10 is inserted into the interior portion 22 of the neck 24 of a wine bottle 26, by placement of the inflatable member 18 within the interior portion 22. The underside peripheral portion 28 of disc 12 rests upon the lip 30 of the bottle 26. Thereafter, an elongated tubular member 32 is placed over the nib 14. The tubular member is connected at its upper end to a source of pressurized inert gas (not shown), such as carbon dioxide or nitrogen, and is provided with a flanged lower end portion 34. The flanged end portion 34 is placed over the free upper end portion 36 of nib 14 and in surrounding engagement therewith and the pressurized inert gas is fed through tubular member 32 and aperture 16 into the interior or hollow 38 of the inflatable member 18. The gas will initially exert a downward force upon the member 18 causing the underside peripheral portion 28 of disc 12 to become firmly seated upon the upper lip surface 29. Immediately thereafter the elastomeric member 18 will expand and be forced into contiguous relationship with the inner circular wall 40 of the neck 24 of the wine bottle; as best seen in FIG. 3. After inflation, the member or sack 18 has a true cylindrical configuration defined by a circular wall 42 and a bottom wall 44 (FIG. 3), with the bottom wall 44 being disposed slightly above the upper level 46 of the wine 48, thereby providing an air space 50.

With the tube 32 still secured to nib 14, a pair of heat fusing elements 52 are caused to be moved inwardly into contact with nib 14, thereby heat sealing the nib 14 and closing the aperture 16. At the same time, the flow of the pressurized inert gas is ceased. Once the aperture 16 is sealed closed, the member 18 forms an hermetic seal within the interior neck portion 22 of the bottle 26. Thereafter, the sealed nib 14 is bent to abuttingly engage the upper surface 54 of disc 12 and a lead foil capsule 56 is placed over the neck 24 of the bottle to prevent undesired and premature opening of the hermetic seal. While the secondary closure member has been described as being a lead foil capsule 56, it wi1 be apparent to those skilled in the art that the same may take the form of a shrink plastic or hard plastic member. Similarly, a screw-on type cap may also be employed since the same is to be employed as a secondary and not a primary closure member.

While the inflatable member 18 has been discussed as being fabricated of an expandable elastomeric material, the same may also be fabricated from any suitable type of alcohol impervious plastic sheet-like material; one example of which is mylar. In this instance, the member 18 should be formed slightly oversized with respect to interior neck portion 22 of the wine bottle 26; i.e., when the member 18 is inflated, as described hereinabove, the diameter of the resultant cylindrical configuration would normally be larger than that of the neck of the wine bottle. However, since the member 18 is inflated when disposed within the interior neck portion 22, the member will have creases or fold-over portions which do not affect the hermetic seal due to the pressure exerted thereon by the gas within the interior of the member 18. Thus, any tendency of the plastic sheet-like material to shrink in the presence of alcohol vapors would be compensated for by the oversizing of the member 18. Materials such as mylar have advantages over elastomeric materials. One advantage is that the microscopic pores in mylar are smaller than in many elastomeric materials and, consequently, air or other gas molecules cannot escape as readily. Moreover, the pores in an elastomeric material might vary in size with an expansion of the material. The pores in mylar are substantially fixed in size and the behavior of the material in actual use may be more accurately predetermined. Mylar has the further advantage of accepting printed or decorative matter. All embodiments of the invention are tamperproof.

It is to be noted that the pressure exerted on the walls 42 by the pressurization of the inflated member maintains the walls in contiguous engagement with the interior neck portion 22, irrespective of any expansion or contraction of the glass of which the bottle is fabricated. The bottle sealing apparatus of the present invention provides all of the advantages of a cork closure while being devoid of the attendant problems inherent therewith. In this regard, cork exhibits a tendency to become dry and crack whereby there is the possibility of air and moisture permeability therethrough. Additionally, cork is susceptible to the growth of bacteria and fungus thereon, while an inert plastic material is a very improbable medium for this condition. Moreover, the placement and positional securement of the sealing device of the present invention in the neck of a bottle is significantly easier and less expensive than is the case with present day cork closures.

Reference is now had to FIG. 4, wherein there is depicted a second embodiment of the present invention, wherein similar parts are denoted by similar reference numerals. The apparatus 10A includes a disc member 12A having a substantially centrally disposed bore 60 formed therein. The inflatable member 18A includes a nib 14A which projects upwardly through the bore 60. The lower flange end 34A of tubular member 32A is placed over the free upper end portion 36A of the nib. In this embodiment, the pressurized inert gas is fed through tube 32A, via the centrally disposed opening 16A formed in nib 14A, into the interior 38A of member 18A. The pressurized gas then inflates member 18A to expand and assume a substantially cylindrical configuration with the circular walls 42A in contiguous engagement with the interior wall 40A of the bottle neck 24A.

After the member 18A has been expanded by the pressurized inert gas, a pair of combined heat sealing and cutting elements or blades 52A are brought into contact with the nib 14A. The elements 52A heat seal the nib 14A, thereby closing the aperture 16A and also cut off the upper end portion 36A of the nib. The closure of aperture 16A enables the member 18A to hermetically seal the bottle neck 24A.

FIG. 5 depicts a third embodiment of the present invention, wherein similar parts are denoted by similar reference numerals. In this embodiment, the disc member 12B is fabricated having a small bore 60B and an inflatable member 18B is secured to the central portion of the underside 20B of the disc member. In this embodiment, the tubular member 32B is formed having a diameter which is smaller than that envisioned and described in conjunction with the previous embodiments. The upper end of member 32B is connected to a source of pressurized gas, while the lower end 62 is inserted through the bore 60B and projects into the interior hollow 38B of the expandable member 18B. Surrounding tubular member 32B is a coaxially disposed sleeve 64 which is radially spaced from the tubular member. The lower end 62 of tubular member 32B extends beneath the lower edge 66 of sleeve 64. After inflation of member 18B, in the manner discussed previously, an epoxy type material is caused to flow downwardly through sleeve 64 in the space between the outer wall of member 32B and the inner wall of sleeve 64. The epoxy material which is of a type which hardens upon contact with air, flows into bore 60B as the lower end 62 of member 32B is withdrawn from the bore. Thus, an epoxy plug 68 is formed within the bore 60B to seal the pressurized interior 38B of member 18B, whereby the neck 24B of the bottle 26B is hermetically sealed by the apparatus 10B. Thereafter, a second closure member such as the lead foil capsule 56B (FIG. 6) is placed over the upper neck portion of the bottle 26B to prevent premature dislocation of the plug 68 and puncture of the hermetic seal.

A fourth embodiment of the invention is depicted in FIG. 7. In this embodiment the structure is substantially the same as that depicted and described in the third embodiment (FIGS. 5 and 6) except that the disc member 12C is fabricated without any preformed bore. In this embodiment a tubular member 32C is provided with a needle-like lower end 62C and the tubular member 32C is heated to an elevated temperature which enables the end 62C to pierce the central portion of disc member 12C to form a small opening 70 therein. Thereafter a pressurized gas is fed via the tube 32C through opening 70 into the interior of the expandable member. The temperature of the tube member 32C is then quickly reduced, such as by a blast of extremely cold air or other gas, as the end 62 is being removed from the opening 70 in the direction shown by arrow 72. This causes the molten portion of the plastic material of disc 12C surrounding opening 70 to flow into the opening 70 and to seal the same as the temperature of the molten portion is abruptly decreased. This action seals the opening 70 and forms a raised bead 74.

It is thus seen that I have provided a new and novel bottle sealing apparatus and method especially for use in conjunction with the sealing of bottles of wine for laying down and subsequent maturation thereof.

The apparatus and method provides an hermetic seal which ensures that there can be no air or moisture permeation through the seal. In the sealing of bottles by means of cork stoppers, the tolerances of the diameter of the devices is critical; however, no such probems are presented by use of the apparatus of the present invention. Attention is also directed to the fact that the utilization of an inert gas to pressurize and inflate the expandable member prohibits any possible contamination of the wine should there by any osmotic transfer of the gas through the walls of the expandable member.

Thus, while I have shown and described the preferred embodiments of the bottle sealing apparatus and method of the present invention, it will be readily apparent to those skilled in the art that there are many changes, modifications and improvements which may be made therein without departing from the spirit and scope of the invention as defined in the appended claims.

1. Apparatus for sealing the neck of a bottle, said neck being of a predetermined diameter, comprising a disc member, and an inflatable member, said inflatable member being made of a flexible but inelastic material and being sized so as to be of greater diameter than said predetermined diameter when fully inflated, means for securing said inflatable member with respect to the underside of said disc member, said disc member being adapted for placement upon the lip of said bottle neck, said inflatable member being adapted for insertion within the neck of said bottle, inflation means operatively associated with said inflatable member to permit the introduction of pressurized fluid into said inflatable member, whereby expansion of said inflatable member causes the same to conform to the configuration of the interior portion of said bottle neck and to form an hermetic seal therein, and means for sealing said inflation means after expansion of said inflatable member.

2. Apparatus for sealing the neck of a bottle in accordance with claim 1, wherein said inflatable member is secured to the underside central portion of said disc member.

3. Apparatus for sealing the neck of a bottle in accordance with claim 2, wherein said disc member is fabricated of a substantially rigid plastic material.

4. Apparatus for sealing the neck of a bottle in accordance with claim 1, including a secondary closure member for encapsulating said disc member and the upper exterior neck portion of said bottle.

5. Apparatus for sealing the neck of a bottle in accordance with claim 1, wherein said inflation means comprises a nib extending upwardly from said disc member, and said nib is in direct fluid flow communication with said inflatable member.

6. Apparatus for sealing the neck of a bottle in accordance with claim 5, wherein said nib is formed integrally with said disc member.

7. Apparatus for sealing the neck of a bottle in accordance with claim 1, wherein said inflation means comprises a nib formed integrally with said inflatable member, said disc member includes a substantially centrally disposed bore formed therein, and said nib projects through said bore and upwardly from said disc member and secures said inflatable member with respect to the underside of said disc member.

8. Apparatus for sealing the neck of a bottle in accordance with claim 7, wherein said disc member and said nib are fabricated of a substantially rigid plastic material.

9. Apparatus for sealing the neck of a bottle in accordance with claim 1, wherein said inflation means comprises a bore formed in said disc member.

10. Apparatus for sealing the neck of a bottle in accordance with claim 1, wherein said inflation means comprises a substantially centrally disposed portion of said disc member adapted to be pierced by a source of pressurized fluid.

11. A method for hermetically sealing the neck of a bottle, said neck being of a predetermined diameter, utilizing a sealing member including an upper member and a lower inflatable member, formed of a flexible but inelastic material and being sized so as to be of a greater diameter than said predetermined diameter if fully inflated, secured to said upper member, comprising the steps of inserting said lower inflatable member into the interior neck portion of said bottle, placing the perimetic underside portion of said upper member upon the lip of said bottle neck to thereby positionally dispose said inflatable member within said bottle neck, expanding said inflatable member by the introduction of a pressurized fluid thereinto to less than its fully inflated diameter but sufficiently to cause conformal adherance thereof with the interior neck portion of said bottle, and thereafter sealing said inflatable member to maintain the same in its expanded configuration and form an hermetic seal, so as to permit subsequent storage and shipment of the contents within said bottle.

12. A method for hermetically sealing the neck of a bottle in accordance with claim 11, including the step of providing a secondary closure member which encapsulates said sealing member and the upper exterior neck portion of said bottle.

13. A method for hermetically sealing the neck of a bottle in accordance with claim 11, wherein said upper member includes a nib projecting upwardly therefrom, including the steps of placing a tubular member which is connected to a source of pressurized fluid upon the upper end of said nib, initiating the flow of said pressurized fluid through said tubular member and into said inflatable member to expand the same, ceasing said flow of pressurized fluid, sealing said inflatable member by heat sealing said nib, and thereafter removing said tubular member from the upper end of said heat sealed nib.

14. A method for hermetically sealing the neck of a bottle in accordance with claim 13, including the steps of bending said heat sealed nib to cause the same to abut the upper surface portion of said upper member, and thereafter encapsulating the nib, upper member and upper exterior neck portion of said bottle.

15. A method for hermetically sealing the neck of a bottle in accordance with claim 14, wherein the step of encapsulating is accomplished by the use of a lead foil member.

16. A method for hermetically sealing the neck of a bottle in accordance with claim 14, wherein the step of encapsulating is accomplished by the use of a plastic member.

17. A method for hermetically sealing the neck of a bottle in accordance with claim 14, wherein the step of encapsulating is accomplished by the use of a screw-on type member.

18. A method for hermetically sealing the neck of a bottle in accordance with claim 11, wherein said upper member includes a nib projecting upwardly therefrom, including the steps of placing a tubular member which is connected to a source of pressurized fluid upon the upper end of said nib, initiating the flow of said pressurized fluid through said tubular member and into said inflatable member to expand the same, ceasing said flow of pressurized fluid, wherein the sealing of said inflatable member is accomplished by the substantially simultaneous steps of heat sealing said nib, removing said tubular member from the upper end of said nib, and cutting off the uppermost end portion of said nib.

19. A method for hermetically sealing the neck of a bottle in accordance with claim 11, wherein said upper member includes a bore therethrough and said inflatable member includes a nib which projects upwardly through said bore, including the steps of placing a tubular member which is connected to a source of pressurized fluid upon the upper end of said nib, initiating the flow of said pressurized fluid through said tubular member and into said inflatable member to expand the same, ceasing said flow of pressurized fluid, sealing said inflatable member by heating sealing said nib, and thereafter removing said tubular member from the upper end of said heat sealed nib.

20. A method for hermetically sealing the neck of a bottle in accordance with claim 11, wherein the step of expanding said inflatable member includes the use of a tubular member having one end thereof connected to a source of pressurized fluid and comprises inserting the unconnected end of said tubular member through an opening formed in said upper member, initiating the flow of said pressurized fluid through said tubular member and into said inflatable member to expand the same, ceasing said flow of pressurized fluid, and the step of sealing said inflatable member is accomplished by closure of said opening formed in said upper member to maintain said inflatable member in its expanded configuration.

21. A method for hermetically sealing the neck of a bottle in accordance with claim 20, wherein said tubular member comprises an inner member and an outer member, said inner member being connected to the source of pressurized fluid, said outer member being connected to a source of amorphous material capable of hardening upon contact with air, the step of expanding said inflatable member includes positioning the unconnected end of said inner tubular member within said inflatable member, and closure of said opening is accomplished by the deposition of said amorphous material into the opening formed in said upper member concomitantly with the withdrawal of said inner tubular member from said opening.

22. A method for hermetically sealing the neck of a bottle in accordance with claim 20, wherein said unconnected end of said tubular member has a truncated conical configuration, said tubular member is operably connected to a heating source for selectively elevating and allowing the lowering of the temperature of said tubular member, said upper member is fabricated of a plastic material, the step of forming an opening in said upper member is accomplished by elevating the temperature of said tubular member and inserting the truncated conical end thereof through said upper member, and the step of sealing said inflatable member after expansion thereof is accomplished by allowing the temprature of said tubular member to lower as the same is being withdrawn from the opening formed in said upper member, to thereby cause the flow of plastic material into the previously formed opening to close the same.

* * * * *